US006142744A

United States Patent [19]

Taylor

[11] Patent Number: 6,142,744

[45] Date of Patent: Nov. 7, 2000

[54] PUMPING SYSTEM AND METHOD FOR MULTIPLE LIQUIDS

[75] Inventor: Ken William Taylor, Oakridge, N.C.

[73] Assignee: Dresser Equipment Group, Inc., Carrollton, Tex.

[21] Appl. No.: 09/321,187

[22] Filed: May 27, 1999

Related U.S. Application Data

[60] Provisional application No. 60/087,273, May 29, 1998.

[51] Int. Cl.[7] ..... F04B 49/00; F04B 23/04

[52] U.S. Cl. ..... 417/53; 417/286; 417/307; 417/313; 417/426

[58] Field of Search ..... 417/286, 307, 417/308, 313, 426, 428; 418/DIG. 1

[56] References Cited

U.S. PATENT DOCUMENTS 2,244,106 6/1941 Granberg et al. .

2,276,895 3/1942 Vosseler et al. ..... 417/428

3,844,688 10/1974 Bulkley et al. .

4,131,395 12/1978 Gusmer et al. ..... 417/426

4,787,822 11/1988 Bennett .

5,842,837 12/1998 Nakayoshi et al. .

*Primary Examiner*—Charles G. Freay

*Attorney, Agent, or Firm*—Haynes and Boone LLP

[57] ABSTRACT

A pumping system and method according to which a plurality of housings are connected together, with each having an inlet and an outlet for respectively receiving and discharging the liquid to be pumped. A single shaft is driven by a motor and extends though all of the housings, and a plurality of rotors are respectively disposed in the housings and are connected to the shaft for rotation therewith. When the shaft is rotated, the rotors pump liquid passing into their corresponding housings from its inlet, through the housing and out its outlet.

39 Claims, 2 Drawing Sheets

PUMPING SYSTEM AND METHOD FOR MULTIPLE LIQUIDS

CROSS-REFERENCE TO RELATED APPLICATION

This application relates to provisional application Ser. No. 60/087,273 filed May 29, 1998.

BACKGROUND

This disclosure relates to a liquid pumping system and, more particularly, to such an system in which multiple pumping assemblies are driven by a single motor.

Pumping systems employing a plurality of individual pumps for pumping different liquids are well known. For example, in a service station for dispensing different grades of gasoline, a pumping unit and a motor for the pumping unit must be provided for each grade of gasoline. Therefore, when multiple grades of fuel are provided, the attendant requirement for a plurality of pumping units and motors considerably adds to the cost, size and complexity of the installation. Even though the different grades of gasoline are often blended, a plurality of pumps and an equal number of motors for the pumps are still required.

Therefore what is need is an system in which a plurality of different liquids can be dispensed from a single pumping unit driven by a single motor.

SUMMARY

According to an example of the present invention, a system is provided that includes a plurality of housings connected together, with each having an inlet and an outlet for respectively receiving and discharging the liquid to be pumped. A shaft is driven by a single motor and extends though all of the housings, and a rotor is disposed in each housing and is connected to the shaft for rotation therewith. When the shaft is rotated, the rotors pump liquid into their respective housings, through the housings and out their respective outlets.

The system of the above example thus enjoys the advantage of requiring only one motor and one pumping unit, thus considerably reducing the cost, size and complexity of the installation. Also, a unique by-pass system is provided that increases the efficiency of the system and thus enable smaller motors to be used. Further, each rotor is located in a separate compartment and the compartment housings are in direct contact with each other to utilize the cooling effect of the lower temperature liquid passing through one housing and rotor to reduce the heat build-up of the other housing and rotors when they are in a bypass mode.

DESCRIPTION OF THE PREFERRED EMBODIMENT

Figure 1:
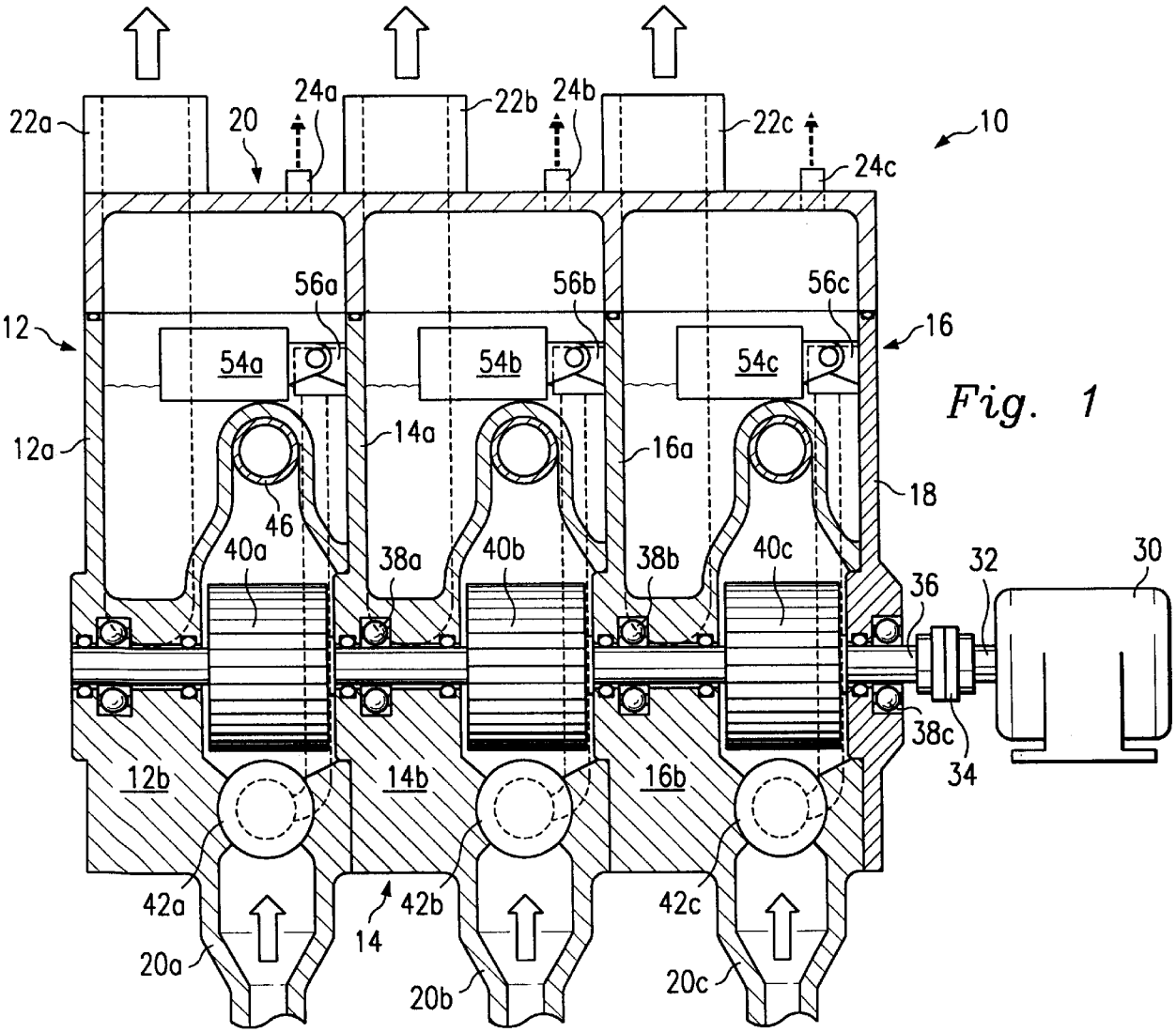
FIG. 1 is a cross-sectional view of the system of the present invention.
Figure 2:
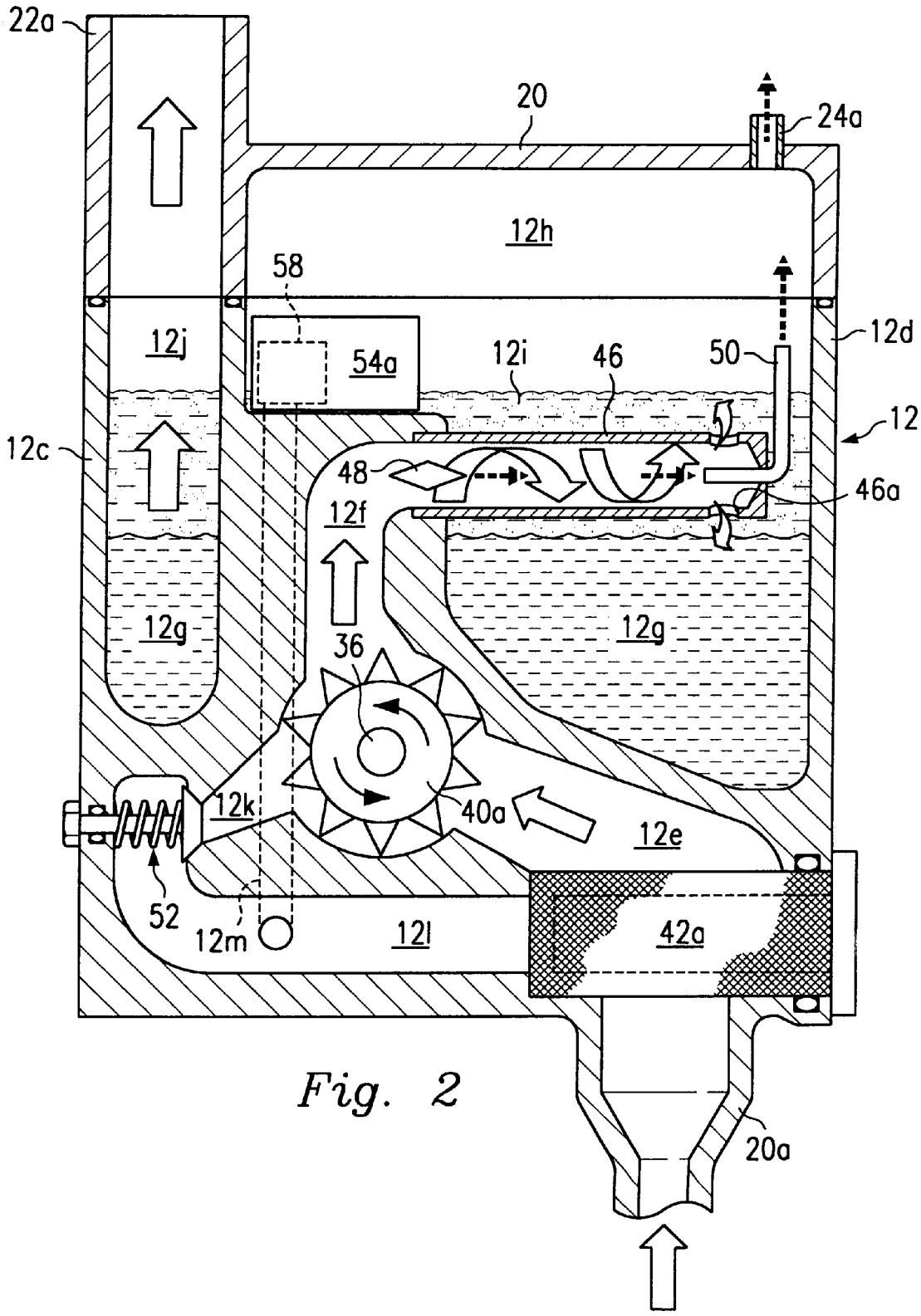
FIG. 2 is a sectional view of the system of FIG. 1 taken along the line 2—2 in FIG. 1

Referring to FIGS. 1 and 2, the reference numeral 10 refers, in general, to the pumping system of the present invention which includes three die-cast housings 12, 14, and 16 extending in an adjacent, parallel relationship. The housings 12, 14, and 16 are provided with front walls 12*a*, 14*a*, and 16*a* and bases 12*b*, 14*b*, and 16*b*, respectively. The bases

12*b*, 14*b*, and 16*b* are relatively thick so as to accommodate passages, chambers, and other components as will be described. The housing 12 is provided with two opposed side walls 12*c* and 12*d* (FIG. 2) and, although not shown, it is understood that the housings 14 and 16 are also provided with two opposed side walls identical to the side walls 12*c* and 12*d*.

The front wall 14*a* of the housing 14 forms a common wall between the housings 12 and 14 and thus serves as the rear wall of the housing 12. Similarly, the front wall 16*a* of the housing 16 forms a common wall between the housings 14 and 16 and thus serves as the rear wall of the housing 14. An end plate 18 is provided that serves as the rear wall of the housing 16.

A cover 20 extends over the housings 12, 14 and 16 and is partitioned in a manner so that the partitions are coextensive with the walls 14*a* and 16*a*, and the ends of the cover are coextensive with the wall 12*a* and the end plate 18, so as to extend the heights of the walls 12*a*, 14*a*, 16*a* and the end plate 18. It is understood that the housings 12, 14, and 16 are connected together through their common walls as discussed above, the end plate 18 is connected to the housing 16, and the cover 20 is connected to the housings 12, 14, and 16 in a conventional manner, such as by bolts, or the like, with conventional seals extending between the connected components.

Three liquid inlets 20*a*, 20*b*, and 20*c* register with openings in the bases 12*b*, 14*b*, and 16*b* of the housings 12, 14, and 16, respectively. The inlets 20*a*, 20*b*, and 20*c* are connected to conduits (not shown) that extend to three storage tanks, or the like (not shown) for receiving three liquids, respectively and for directing the liquids through the inlets and into the housings12, 14, and 16, respectively. In a gasoline dispensing installation, for example, the liquids would be different grades of gasoline.

Three liquid outlets 22*a*, 22*b*, and 22*c* register with openings in the cover 20 and are connected to conduits (not shown) that extend to external apparatus for further treatment. In a gasoline service station environment, for example, the latter conduits would be connected to conventional gasoline meters or dispenser units for dispensing the grades of gasoline to vehicles.

Three vent pipes 24*a*, 24*b*, and 24*c* also register with openings in the cover 20 and function to vent air from the housings 12, 14, and 16, respectively, under conditions to be described.

A motor 30 is disposed adjacent the housing 16 and operates in a conventional manner to rotate a drive shaft 32. A flange coupling 34 couples the drive shaft 32 to a rotor shaft 36 that extends though each of the housings 12, 14, and 16. Four bearing units 38*a*, 38*b*, and 38*c* are disposed in the bases 12*b*, 14*b*, 16*b*, and the end plate 18, respectively, for supporting the rotor shaft 36 for rotation in a conventional manner.

Three rotors 40*a*, 40*b*, and 40*d* are coupled to the shaft 36 in any known manner for rotation with the shaft, and extend in the housings 12, 14, and 16, respectively. The rotors 40*a*, 40*b*, and 40*c* are adapted to pump liquid from the inlets 20*a*, 20*b*, and 20*c*, respectively, through the housings 12, 14 and 16, respectively, and to the outlets 22*a*, 22*b*, and 22*c* respectively, under conditions to be described.

Three cylindrical filters 42*a*, 42*b*, and 42*c* are mounted in the housings 12, 14, and 16, respectively, in any conventional manner just downstream of the inlets 20*a*, 20*b* and 20*c* respectively, for filtering solid particles from the liquid entering the housings 12, 14, and 16, respectively.

As better shown in FIG. 2, the interior of the housing 12 is provided with several passages and chambers for receiving liquid and directing the liquid through the housing and the rotor 40*a*. More particularly, an inlet passage 12*e* connects the filter 42*a* to the rotor 40*a*, and an outlet passage 12*f* extends from the rotor. Thus, the rotor 40*a* draws the filtered liquid from the filter 42*a* into and through the inlet passage 12*e*. The liquid then passes through the rotor 40*a* and through the outlet passage 12*f*.

An air separation tube 46 is mounted in the interior of the housing 12 and registers with the outlet passage 12*f* for receiving the liquid from the latter passage and separating the liquid from any air that may be mixed with the liquid. To this end, a deflector 48 is provided in the upstream end portion of the tube 46 to impart a swirling flow pattern to the liquid as it passes through the tube 46. This causes the heavier liquid to accumulate against the inner wall of the tube 46 and any lighter air to concentrate in the radial center portion of the tube. A liquid chamber 12*g* surrounds the rotor 40*a* and that portion of the housing defining the inlet and outlet passages 12*e* and 12*f*, respectively. The separated liquid passes from the tube 46 and into the chamber 12*g* through a plurality of angularly-spaced openings 46*a* formed through the tube and around its circumference near the distal end thereof.

An air chamber 12*h* is formed in the upper portion of the housing 12 including that portion of the housing defined by the cover 20. One end of an L-shaped air pipe 50 extends into the radial center of the open distal end of the tube 46 for receiving the separated air in the center of the tube and directing the air up to the air chamber 12*h* from which it vents through the vent pipe 24*a*. A transition region 12*i* is defined in the interior of the housing that extends between the liquid chamber 12*g* and the air chamber 12*h*. This region 12*i* contains a frothy mixture of the liquid and the air.

An outlet passage 12*j* for the separated liquid is formed on one side of the interior of the housing, extends through the cover 20, and connects a portion of the liquid chamber 12*g* with the outlet 22*a* on the cover 20. Thus, the separated liquid from the tube 46 accumulates in the chamber 12*g* and passes from the latter chamber, through the passage 12*j*, and the outlet 22*a* and externally of the system 10. In the case of a gasoline dispensing installation, the liquid, or gasoline, would be passed to a gasoline dispenser for dispensing into vehicles.

Since all three rotors 40*a*, 40*b* and 40*c* are coupled to the rotor shaft 36 they all will rotate with the shaft 36 and thus commence pumping liquid into the inlets 20*a*, 20*b* and 20*c* when the motor 30 is actuated. However, despite this, the system 10 is designed to permit only one of the liquids to be pumped to its corresponding outlet 22*a*, 22*b* or 22*c*, while the other liquids are not discharged from their corresponding housings—a situation that will occur in a gasoline dispensing installation, for example, when a single, non-blended grade of gasoline is selected by the customer. In this situation, and assuming the liquid associated with the housing 12 is not to be pumped through the housing, a downstream valve, or the like (not shown), associated with the outlet 20*a* would be closed, which in the case of a gasoline dispensing installation, would be a valve on the dispensing nozzle 12. To prevent the liquid associated with the housing 12 from being discharged from the housing, a bypass passage 12*k* (FIG. 2) is formed in the housing 12 and registers with a portion of the rotor 40*a* opposite that portion that receives the liquid from the inlet passage 12*e*. One end of a recirculation passage 12*l*, also formed in the housing 12, registers with the bypass passage 12*k* and the other end registers with the inlet 20*a*. A check valve 52 is located in the upstream end portion of the recirculation passage 12*l*and can be a conventional adjustable spring pressure open/close type of valve that is normally biased to the closed position shown, but moves to an open position in response to a predetermined, relatively high, liquid pressure acting against it.

Thus, when the motor 30 is actuated, the rotor 40*a* in the housing 12 initially pumps the liquid from the inlet 20*a* of the housing 12 through the passages 12*e* and 12*f*, and to the air separation tube 46. The separated liquid discharges from the tube and accumulates in the chamber 12*g*. However, since there is no flow from the housing 12 through the outlet 22*a* since its corresponding downstream valve is closed, the liquid pressure builds up rapidly in the housing 12 and the passage 12*k* until it is sufficient to open the valve 52.

This permits the pumped liquid to pass through the passages 12*k* and 12*l* and back to the inlet 20*a* for recirculation. Thus, as long as the valve 52 is open no liquid is discharged from the housing 12 through its corresponding outlet 22*a*.

Thus, the pumping of the liquids through their respective housing 12, 14, and 16 can be selectively controlled by turning the downstream valves associated with the housings on or off. As a result, two valves can be turned off and one valve turned on resulting in the pumping of the liquid associated with the latter valve. Also, two of the valves can be turned on and one valve turned off, resulting in the pumping of two liquids through their respective housings 12, 14, or 16. In the latter case, in a gasoline dispensing installation the two pumped fuels would be blended in a conventional manner before being dispensed into a vehicle.

Referring to FIG. 1, three float units 54*a*, 54*b*, and 54*c* are provided in the housings 12, 14 and 16 and are pivotally mounted to support member 56*a*, 56*b*, and 56*c* disposed in the housings. As shown in FIG. 2, the float unit 54*a* is located in the region 12*i* in the housing 12 and is designed to control the liquid level in the chamber 12*g* especially in situations when, for whatever reason, the rotor 40*a* is pumping more liquid into the housing than is discharging from the housing through the outlet 22*a*. More particularly, when the rotor 40*a* is pumping the liquid, the float unit 54*a* responds to the liquid level in the housing rising to a level sufficient to raise the float portion of the unit and opens a valve 58 associated with the unit. An additional recirculation passage 12*m* extends from the valve 58 to the inlet 20*a* for recirculating the liquid. This eliminates an undesirable build-up of liquid in the housing 12 which could cause the liquid to spill out through the vent 24*a*. Of course, in situations when the rotor 40*a* is pumping liquid but the valve associated with the outlet 22*a* is turned off, the float 54*a* would rise to open the valve and some of the fluid would be recirculated from the upper portion of the housing, via the passage 12*m* and to the recirculation passage 12*l*, as discussed above.

It can be appreciated that the various passages and chambers discussed above are formed in the base 12*a* of the housing 12, and the components discussed above are accommodated and mounted in the housing, in any known manner, such as by formed in base with two or more sections, or the like. It is also understood that since the housings 14 and 16 are identical to the housing 12 and contain passages, chambers, and components identical to those contained in the housing 12, the housings 14 and 16, and their associated components, will not be described in detail.

In operation, when it is desired to pump one or more of the three liquids respectively stored in three storage tanks, the motor 30 is activated to drive the shaft 36 and thus rotate the rotors 40*a*, 40*b*, and 40*c*. Assuming that the liquid in the storage tank associated with the housing 12 is selected to be pumped through the latter housing and to the outlet 22*a*, the downsteam valve associated with the latter outlet is opened. The liquid thus passes into and through the inlet 20*a*, through the filter 42*a* and into and through the passage 12*e*. The liquid then passes through the rotor 40*a* and discharges from the rotor into the passage 12*f* through which it flows into the air separation tube 46. Any air mixed with the liquid is separated from the liquid in the tube 46 in the manner described above. The separated liquid discharges from the openings 46*a* in the tube 46 and into the liquid chamber 12*g* where it accumulates and flows, via the passage 12*j* into and through the outlet 22*a* for passage to an external location, such as a dispensing unit of a gasoline dispensing system. The separated air passes through the pipe 50 to the air chamber 12*h* from which it exits, via the vent pipe 24*a*. This air can be discharged into the atmosphere or, in the case of a gasoline dispensing installation, into a vapor recovery system, or the like.

If, during the above operation, the liquid level in the housing 12 rises to the extent that it activates the float unit 54*a*, the valve 58 is opened causing some of the liquid to recirculate through the passage 12*m* and back to the inlet 20*a* as described above.

Since the pumping assemblies in the housings 14 and 16 operate in an identical manner to the pumping assemblies in the housing 12 they will not be described in detail. Of course, in the above example, if the downstream valve associated with one or both of the outlets 22*b* and 22*c* of the housing 14 and 16, respectively are turned off, the operation will be the same as described above in connection with the housing 12 when its downstream valve is shut off, i.e. no liquid will be discharged from the housing 14 and/or 16.

The present invention enjoys several advantages as follows:

1. A single motor and shaft drives a plurality of rotors in separate housings or compartments for dispensing multiple liquids, thus considerably reducing the cost, size and complexity of the installation.
2. Each housing, and its associated pumping assembly, is a standalone unit permitting an installation to include a single, or any number of multiple housings and thus realize efficiencies in manufacturing.
3. Due to the fact that the adjacent housings have a common wall, the rotor(s) that are not dispensing but rather are running in their bypass mode are cooled by the housing in which the dispensing rotor extends.
4. The float valve associated with each pumping assembly provides a safety feature to prevent liquid from exiting the vent if the air separation chamber becomes completely filled with liquid.
5. The air separation chamber enables any air that may get mixed with the liquid when the pumping assemblies are being primed, or when a suction leak exists, to be vented to atmosphere, or to a vapor recovery system.
6. The pumping assemblies can be adapted to non-standard liquids, such as diesel gasoline, by using a larger top cover to define a larger separation chamber. Also, in a system involving multiple pumping units for different gasoline products, for example, including diesel and standard gasoline, in which case the housing for the diesel gasoline could have a larger separation chamber.

It is understood that variations may be made in the foregoing without departing from the scope of the present invention. For example, the number of housing and their associated pumping assemblies can be varied within the scope of the invention. Also, the separate housings could be replaced with a single housing having compartments for housing the pumping assemblies. Further, the spring-loaded bypass valve could be replaced by a solenoid valve having its coils mounted externally of the housing and controlled electronically relative to the required pumping rate to provided maximum efficiency. Also, the by-pass valve in each housing could be eliminated and the rotor could be magnetically coupled to the drive shaft, with the force of the coupling set to equate to the required by-pass pressure. In this arrangement, the rotor would slip on the shaft and therefore stop the pumping when the required by-pass pressure is reached. Also, a magnetic coil that is energized when flow is required could be used instead of a magnetic coupling.

Further, the air separators could be eliminated and the air could be monitored using ultrasonic air detection, and the system shut down if a predetermined amount of air is detected. Still further, the filters could be mounted externally of their respective housings, and before the inlets to the housings to provide for easier access and permit larger size filters to be accommodated.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A pumping system comprising:

a plurality of housings connected together, each having an inlet and an outlet;

a single shaft extending though all of the housings;

a plurality of rotors respectively disposed in the housings and connected to the shaft for rotation therewith;

means for rotating the shaft and therefore the rotors to pump liquid into each housing from its inlet for passage through the housing;

a separator disposed in each housing for separating from the liquid any air that is mixed with the liquid; and a chamber formed in each housing and having a first portion for receiving the separated liquid and a second portion for receiving the separated air.

2. The system of claim 1 wherein the rotating means comprised a motor drivingly connected to the shaft.

3. The system of claim 1 wherein the liquid normally passes from the rotor and to its corresponding outlet for discharge from the housing, and further comprising a bypass system formed in each housing for routing the liquid from each rotor back to its corresponding inlet when its corresponding outlet is closed.

4. The system of claim 3 wherein the bypass system comprises a bypass conduit connecting the output of each rotor to its corresponding inlet, and a valve disposed in the conduit for normally closing the conduit and for responding to the pressure in the corresponding housing attaining a predetermined value for opening the conduit.

5. The system of claim 1 further comprising a vent associated with each housing for venting the separated air from the air chamber, and a passage formed in each housing and extending from its corresponding liquid chamber to its corresponding outlet.

6. The system of claim 1 further comprising a float assembly disposed in each housing for responding to the liquid level in each housing attaining a predetermined height for recirculating the liquid back to the corresponding inlet.

7. The system of claim 1 wherein each housing has a front wall and a bottom wall, and wherein the front wall of each housing serves as a common wall between the latter housing and its adjacent housing and thus forms the rear wall of the adjacent housing.

8. A pumping system comprising:

a plurality of housings connected together, each having an inlet and an outlet;

a single shaft extending though all of the housings;

a plurality of rotors respectively disposed in the housings and connected to the shaft for rotation therewith;

means for rotating the shaft and therefore the rotors to pump liquid into each housing from its inlet for passage through the housing; and a float assembly disposed in each housing for responding to the liquid level in each housing attaining a predetermined height for recirculating the liquid back to the corresponding inlet.

9. The system of claim 8 wherein the rotating means comprised a motor drivingly connected to the shaft.

10. The system of claim 8 wherein the liquid normally passes from the rotor and to its corresponding outlet for discharge from the housing, and further comprising a bypass system formed in each housing for routing the liquid from each rotor back to its corresponding inlet when its corresponding outlet is closed.

11. The system of claim 10 wherein the bypass system comprises a bypass conduit connecting the output of each rotor to its corresponding inlet, and a valve disposed in the conduit for normally closing the conduit and for responding to the pressure in the corresponding housing attaining a predetermined value for opening the conduit.

12. The system of claim 8 further comprising a separator disposed in each housing for separating from the liquid any air that is mixed with the liquid, a chamber formed in each housing and having a first portion for receiving the separated liquid and a second portion for receiving the separated air.

13. The system of claim 12 further comprising a vent associated with each housing for venting the separated air from the air chamber, and a passage formed in each housing and extending from its corresponding liquid chamber to its corresponding outlet.

14. The system of claim 8 wherein each housing has a front wall and a bottom wall, and wherein the front wall of each housing serves as a common wall between the latter housing and its adjacent housing and thus forms the rear wall of the adjacent housing.

15. A pumping system comprising:

a plurality of compartments connected together, each having an inlet and an outlet;

a single shaft extending though all of the compartments;

a plurality of rotors respectively disposed in the compartments and connected to the shaft for rotation therewith;

means for rotating the shaft and therefore the rotors to pump liquid into each compartment from its inlet for passage through the compartment;

a separator disposed in each compartment for separating from the liquid any air that is mixed with the liquid; and a chamber formed in each compartment and having a first portion for receiving the separated liquid and a second portion for receiving the separated air.

16. The system of claim 15 wherein the liquid normally passes from the rotor and to the outlet for discharge from the compartment, and further comprising a bypass system formed in each compartment for routing the liquid from the rotor back to its corresponding inlet when its corresponding outlet is closed.

17. The system of claim 16 wherein the bypass system comprises a bypass conduit connecting the output of each rotor to its corresponding inlet, and a valve disposed in the conduit for normally closing the conduit and for responding to the pressure in its corresponding compartment attaining a predetermined value for opening the conduit.

18. The system of claim 15 further comprising a vent associated with each compartment for venting the separated air from the air chamber, and a passage formed in each compartment and extending from its corresponding liquid chamber to its corresponding outlet.

19. The system of claim 15 wherein each compartment has a front wall and a bottom wall, and wherein the front wall of each compartment serves as a common wall between the latter compartment and its adjacent compartment and thus forms the rear wall of the adjacent compartment.

20. The system of claim 15 wherein the rotating means comprised a motor drivingly connected to the shaft.

21. A method of pumping liquids from a plurality of sources, the method comprising the steps of:

connecting a plurality of housings together, providing an inlet and an outlet on each housing;

installing a single shaft extending though all of the housings;

providing a rotors in each housing;

connecting the rotors to the shaft for rotation therewith;

rotating the shaft, and therefore the rotors, to pump liquid into each housing from its inlet and through the housing;

separating from the liquid in each housing any air that is mixed with the liquid, routing the separated liquid to a first portion of a chamber formed in each housing; and routing the separated air to a second portion of the chamber.

22. The method of claim 21 wherein the step of rotating comprises the step of connecting a motor to the shaft.

23. The method of claim 21 wherein the liquid normally passes from each rotor and to its corresponding outlet for discharge from its corresponding housing, and further comprising the step of routing the liquid from each rotor back to its corresponding inlet when its corresponding outlet is closed.

24. The method of claim 23 further comprising the step of responding to the pressure in each housing attaining a predetermined value and routing the liquid from the corresponding rotor back to the corresponding inlet.

25. The method of claim 21 further comprising the steps of routing the separated liquid from each liquid chamber to its corresponding outlet and venting the separated air from each air chamber.

26. The method of claim 21 further comprising the steps of responding to the liquid level in each housing attaining a predetermined height for recirculating the liquid back to the corresponding inlet.

27. A pumping system comprising:

a plurality of compartments connected together, each having an inlet and an outlet;

a single shaft extending though all of the compartments;

a plurality of rotors respectively disposed in the compartments and connected to the shaft for rotation therewith;

means for rotating the shaft and therefore the rotors to pump liquid into each compartment from its inlet for passage through the compartment; and a float assembly disposed in each compartment for responding to the liquid level in each compartment attaining a predetermined height for recirculating the liquid back to the corresponding inlet.

28. The system of claim 27 wherein the rotating means comprised a motor drivingly connected to the shaft.

29. The system of claim 27 wherein the liquid normally passes from the rotor and to the outlet for discharge from the compartment, and further comprising a bypass system formed in each compartment for routing the liquid from the rotor back to its corresponding inlet when its corresponding outlet is closed.

30. The system of claim 29 herein the bypass system comprises a bypass conduit connecting the output of each rotor to its corresponding inlet, and a valve disposed in the conduit for normally closing the conduit and for responding to the pressure in its corresponding compartment attaining a predetermined value for opening the conduit.

31. The system of claim 27 further comprising a separator disposed in each compartment for separating from the liquid any air that is mixed with the liquid, a chamber formed in each compartment for receiving the separated liquid, a chamber disposed in the compartment for receiving the separated air.

32. The system of claim 31 further comprising a vent associated with each compartment for venting the separated air from the air chamber, and a passage formed in each compartment and extending from its corresponding liquid chamber to its corresponding outlet.

33. The system of claim 27 wherein each compartment has a front wall and a bottom wall, and wherein the front wall of each compartment serves as a common wall between the latter compartment and its adjacent compartment and thus forms the rear wall of the adjacent compartment.

34. A method of pumping liquids from a plurality of sources, the method comprising the steps of:

connecting a plurality of housings together, providing an inlet and an outlet on each housing;

installing a single shaft extending though all of the housings;

providing a rotors in each housing;

connecting the rotors to the shaft for rotation therewith;

rotating the shaft, and therefore the rotors, to pump liquid into each housing from its inlet and through the housing; and responding to the liquid level in each housing attaining a predetermined height for recirculating the liquid back to the corresponding inlet.

35. The method of claim 34 wherein the step of rotating comprises the step of connecting a motor to the shaft.

36. The method of claim 34 wherein the liquid normally passes from each rotor and to its corresponding outlet for discharge from its corresponding housing, and further comprising the step of routing the liquid from each rotor back to its corresponding inlet when its corresponding outlet is closed.

37. The method of claim 36 further comprising the step of responding to the pressure in each housing attaining a predetermined value and routing the liquid from the corresponding rotor back to the corresponding inlet.

38. The method of claim 34 further comprising the steps of separating from the liquid in each housing any air that is mixed with the liquid, routing the separated liquid to a chamber formed in each housing, and routing the separated air to a chamber disposed in each housing.

39. The method of claim 38 further comprising the steps of routing the separated liquid from each liquid chamber to its corresponding outlet and venting the separated air from each air chamber.

* * * * *